United States Patent [19]

Brown

[11] Patent Number: 4,815,938

[45] Date of Patent: Mar. 28, 1989

[54] SHROUD GAP CONTROL FOR INTEGRAL SHROUDED BLADES

[75] Inventor: Wilmott G. Brown, Winter Park, Fla.

[73] Assignee: Westinghouse Electric Corp., Pittsburgh, Pa.

[21] Appl. No.: 137,644

[22] Filed: Dec. 24, 1987

[51] Int. Cl.[4] ..... F01D 5/16; F01D 05/22

[52] U.S. Cl. ..... 416/190; 416/191

[58] Field of Search ..... 416/190, 191, 196 R, 416/195, 500

[56] References Cited

U.S. PATENT DOCUMENTS

| | | | |
|---|---|---|---|
| 2,430,140 | 11/1947 | Phelan et al. | 416/191 X |
| 3,576,377 | 4/1971 | Beanland et al. | 416/191 |
| 3,938,906 | 2/1976 | Michel et al. | 415/139 |
| 3,981,615 | 9/1976 | Krol | 416/191 X |
| 4,257,743 | 3/1981 | Fujii | 416/196 R |
| 4,533,298 | 8/1985 | Partington et al. | 416/191 |
| 4,602,412 | 7/1986 | Partington et al. | 29/156.8 B |
| 4,722,668 | 2/1988 | Novacek | 416/500 X |

FOREIGN PATENT DOCUMENTS

| | | | |
|---|---|---|---|
| 873151 | 6/1971 | Canada | 416/191 |
| 1503453 | 3/1978 | United Kingdom | 416/191 |

*Primary Examiner*—Everette A. Powell, Jr.

[57] ABSTRACT

In turbines, gaps arising between adjacent shrouds of integrally shrouded blades at high temperature are controlled or eliminated using pins inserted into opposing faces of shroud portions. These pins have a coefficient of thermal expansion greater than the integrally shrouded blade material and at least equal to that of the rotor material and, thus, protrude outwardly at operating temperatures. These protruding pins act to close the gap between shroud portions, thereby reducing vibration.

17 Claims, 3 Drawing Sheets

SHROUD GAP CONTROL FOR INTEGRAL SHROUDED BLADES

BACKGROUND OF THE INVENTION

1. Field of the Invention

The present invention generally relates to steam turbines. More specifically, the present invention relates to an apparatus and method for reducing relative motion between the blades of a turbine.

2. Description of the Prior Art

In turbines, e.g., steam turbines, a plurality of rotating arrays of foils or blades are arranged circumferentially about a rotor. Reaction of steam or gases against the blades produces rotation of the rotor and associated blade arrays. The forces acting on these rotating blades, including centrifugal forces caused by rotation, tend to throw the blades radially outward and generate large forces on the blade attachment structure. In many turbines, the attachment structure comprises a fir tree-shaped root structure that slides into a mating slot or groove in the rotor. When the blade is properly positioned, lugs extending from opposing sides of the root structure share equally in retaining a blade to the rotor; however, if a blade is aligned off of a radial line of the rotor through the center of the rotor groove, lugs on one side of the root structure may support more force than those on the opposite side, leading to potential overstress conditions. Accordingly, it is desirable to assure that turbine blades are aligned with their respective centerlines oriented along axial radial lines of the turbine rotor.

Such arrays of rotating blades are often joined together at their tips by a shroud ring that is normally riveted to the blade via a tenon made integral with the blade. The tenon, being an abrupt change in cross section of the blade, is subject to higher stresses due to bending moments imposed by the shroud ring and also provides crevices wherein corrosion products are accumulated. However, the shroud ring also provides a steam seal over the top of the blade as well as reducing blade vibration to some extent. One prior art turbine blade that eliminates the problems of tenon stress and corrosion is disclosed in U.S. Pat. No. 4,533,298, issued to Albert J. Partington et al on Aug. 6, 1985, assigned to the assignee of the present invention, and incorporated herein by reference.

Partington et al teach a plurality of rotatable blades disposed in a circular array, each blade comprising a root portion, which fastens the blades to the rotor, an air foil-shaped blade portion having a leading edge and a trailing edge, and a shroud portion made integral with the blade portion and disposed on the radially outer end of the blade portion. The shroud portion has a leading planar surface and a trailing surface, the trailing planar surface being disposed generally parallel to an axial radial plane passing through the central portion of the root portion, and the leading planar surface, if extended, forming an angle with the radial axial plane passing through the center of the root portion generally equal in degrees to 360 divided by the number of blades forming the circular array. A method for assembling such turbine blades is disclosed in U.S. Pat. No. 4,602,412, also issued to Partington et al on July 29, 1986, assigned to the assignee of the present invention and incorporated herein by reference.

Other commonly assigned copending applications reflect the current state of the art with respect to shroud arrays. Reference is thus made to commonly assigned copending application Ser. No. 018,321, filed Feb. 24, 1987 and to commonly assigned copending application Ser. No. 53,300, filed May 22, 1987.

In typical steam turbines, the rotor material differs from the blade material, with integrally formed shrouds being comprised of the same material as the blades. The coefficient of thermal expansion of the rotor material is usually greater than that of the integrally shrouded blades. Thus, if the integrally shrouded blades are assembled cold with a minimum of clearance between the mating shrouds, then, upon heating to a higher operating temperature, such as is experienced in a high or intermediate pressure turbine, a gap will develop between adjacent shrouds due to the different coefficients of thermal expansion between the rotor and the integrally shrouded blades. This gap can lead to vibration of the blades, during full speed operation.

Accordingly, there is a need for an apparatus and method of controlling the shroud gap for integrally shrouded blades at higher operating temperature conditions to minimize the vibration of the blades during full speed operation.

SUMMARY OF THE INVENTION

The present invention is directed to an apparatus for controlling the shroud gap between adjacent shrouds of integrally shrouded blades for use in steam turbines. To this end, pins made out of a material having a coefficient of thermal expansion greater than the shroud or blade material and equal or greater than the coefficient of thermal expansion of the rotor material are inserted into the sides of the shrouds prior to shroud machining. By machining the shrouds thereafter, the pins, during cold assembly, remain flush with the side of each shroud. Upon heating during normal operation, however, these pins expand at a greater rate than that of the shroud material and, thus, jut out from the sides of the shrouds.

By jutting out during operation, these pins will maintain contact or snub against adjacent shrouds and/or adjacent shroud pins, thereby reducing vibration of the blades. By controlling the depth of the pins, the gap can be controlled or eliminated between shrouds at operating temperature.

Accordingly, it is an object of the present invention to provide an apparatus and method for controlling the gap between adjacent shrouds in steam turbines having integrally shrouded blades.

An advantage of the present invention is to reduce vibration of the blades during operation. This and further objects and advantages will be apparent to those skilled in the art in connection with the detailed description of the preferred embodiments set forth below.

DESCRIPTION OF THE PREFERRED EMBODIMENTS

Figure 4:
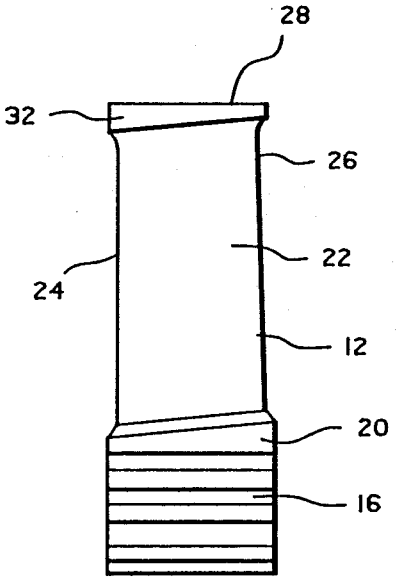
FIG. 4 is a tangential view of the integrally shrouded blade.
Figure 3:
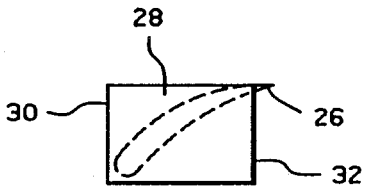
FIG. 3 is a radial view of an integrally shrouded blade.
Figure 1:
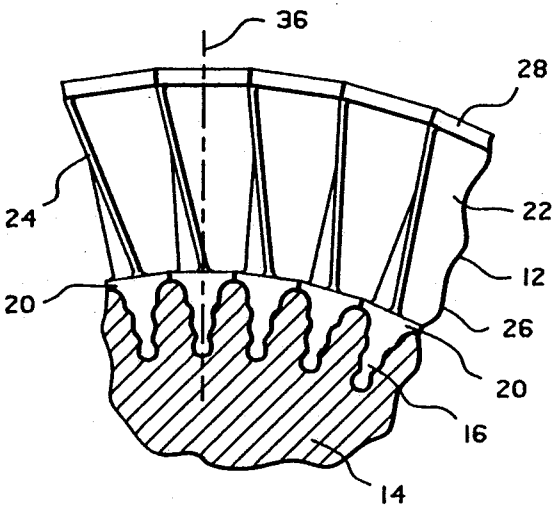
FIG. 1 is a partial section view of a circular array of rotatable blades disposed in a rotor.

Turning in detail to the drawings, wherein like characters designate like or corresponding parts throughout the several views, there is shown in FIG. 1 a portion of a circumferential array of exemplary turbine blades 12 disposed in a portion of a turbine rotor 14.

As best shown in FIGS. 1, 2, 4, and 5, each turbine blade 12 comprises a fir tree-shaped root portion 16 that registers with a similarly shaped slot or groove 18 in the rotor 14 to fasten the blades 12 to the rotor 14. A locking device is used in order to prevent axial movement of the blades 12. The root portion 16 extends from a blade platform 20.

Figure 5:
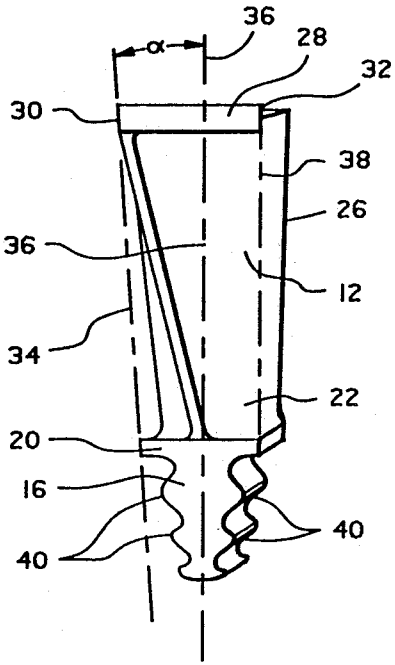
FIG. 5 is an axial view of a integrally shrouded blade.

Extending axially radially outwardly from the blade platform portion 20 is an air foil-shaped blade portion 22 having leading and trailing edges 24 and 26, respectively. Disposed radially outwardly of the blade portion 22, and made integral therewith, is a shroud portion 28. The shroud portion 28 has a leading planar surface 30 and a trailing planar surface 32. The trailing planar surface 32 as indicated by the line 38 in FIG. 5 is generally parallel to an axial radial plane 36 passing through the center portion (i.e., "blade center line") of the root portion 16. The leading planar surface 30, if extended as indicated at 34 in FIG. 5, forms an angle "$\alpha$" with the axial radial plane 36 that is generally equal in degrees to 360 divided by the number of blades in the circular array.

The leading planar surface 30 extends beyond the leading edge 24 of the blade portion 22, while the trailing edge 26 of the blade portion 22 extends substantially beyond the trailing planar surface 32 of the shroud portion 28. As is conventional, the outer periphery of the shroud portion 28 can be machined to form a cylindrical ring and cooperates with labyrinth seals to form a rotating seal.

Each of the blades 12 is desirably aligned on a radial line of the rotor 14, or more specifically the blade center line 36 desirably coincides with a radial line of the rotor 14. In such an alignment, each lug portion 40 on the root portion 16 shares the centrifugal forces on blades 12 during turbine operation. If one of the blades 12 is misaligned, its root portion 16 may be stressed off-center, causing a force increase on one or more of the lug portions 40 on only one side of the root portion 16. Such force increase may exceed the stress capability of the root structure, resulting in blade root damage or may damage the rotor groove 18 in which the blade root portion 16 is retained. Since blade separation, whether from root failure or rotor groove failure, can be disastrous in a turbine, it is desirable to assure proper blade alignment at the tip of assembly.

Figure 2:
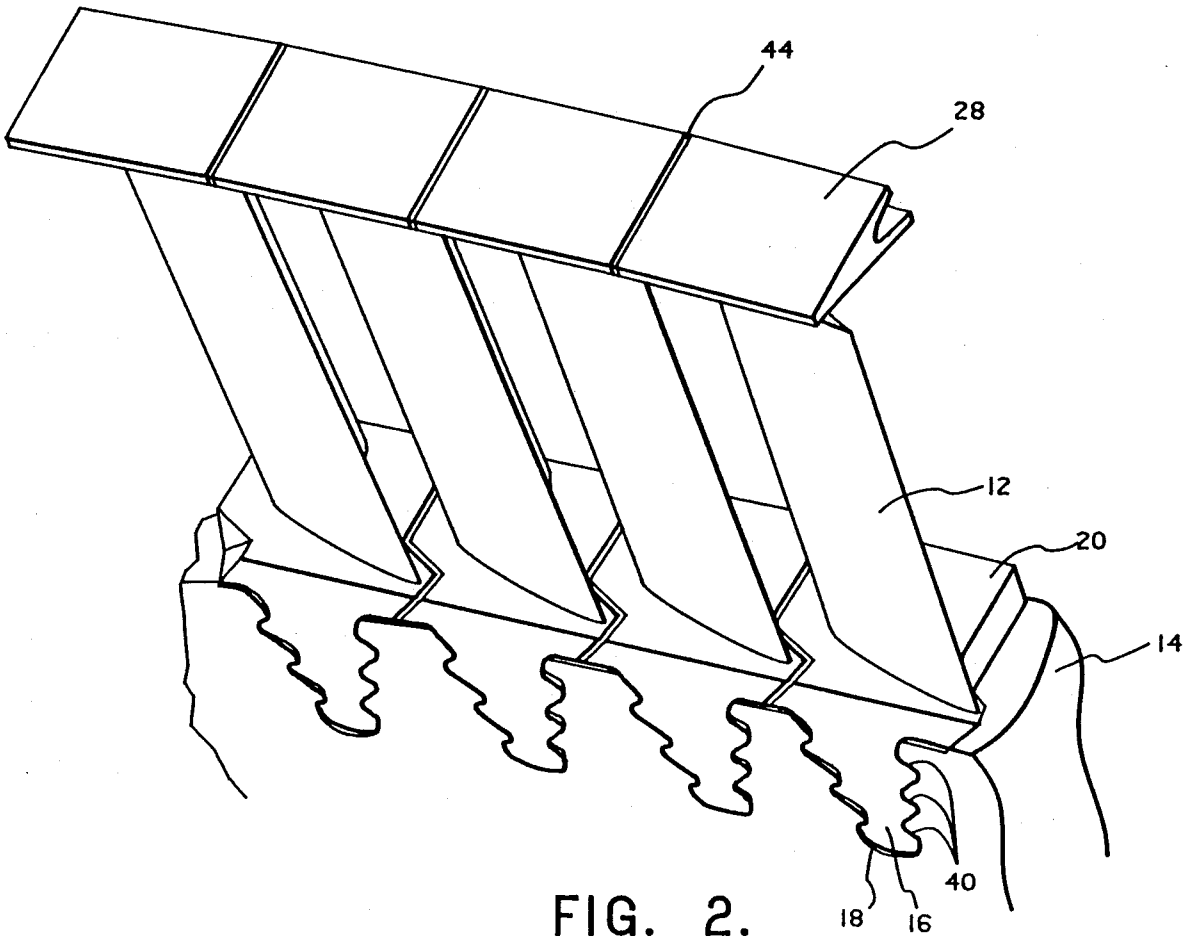
FIG. 2 is a perspective view of a section of a turbine.

FIG. 2 illustrates from another angle a portion of a turbine comprising a rotor 14 and a plurality of blades 12. FIG. 2 illustrates the portion shown from a side opposite to that of FIGS. 1 and 5. As also illustrated in FIG. 2, there may be a small clearance or gap 44 between adjacent shrouds 28 which may open further under hot rotor conditions. This gap 44 can lead to blade system vibration, and is the main problem solved by the device of the present invention.

Figure 8:
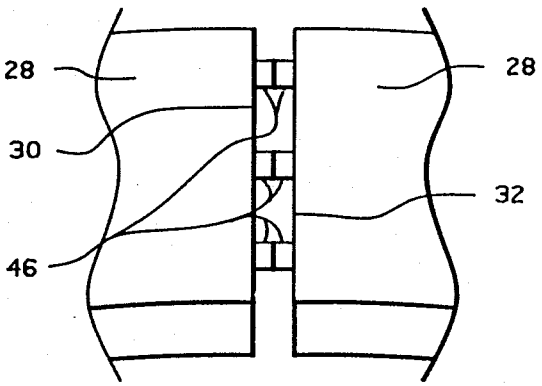
FIG. 8 is a blown up side view of two adjacent integrally shrouded blades incorporating another configuration of the device of the present invention showing the operation of said device.
Figure 7:
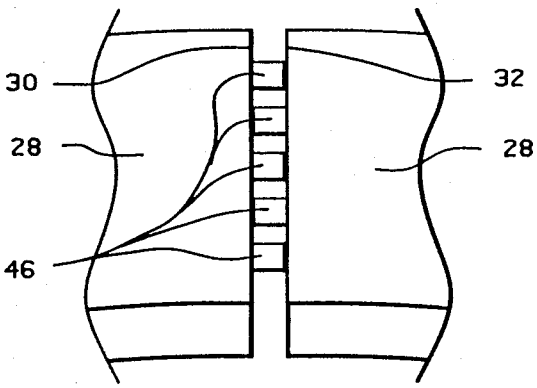
FIG. 7 is a blown up side view of two adjacent integrally shrouded blades incorporating one configuration of the device of the present invention showing the operation of said device.
Figure 6:
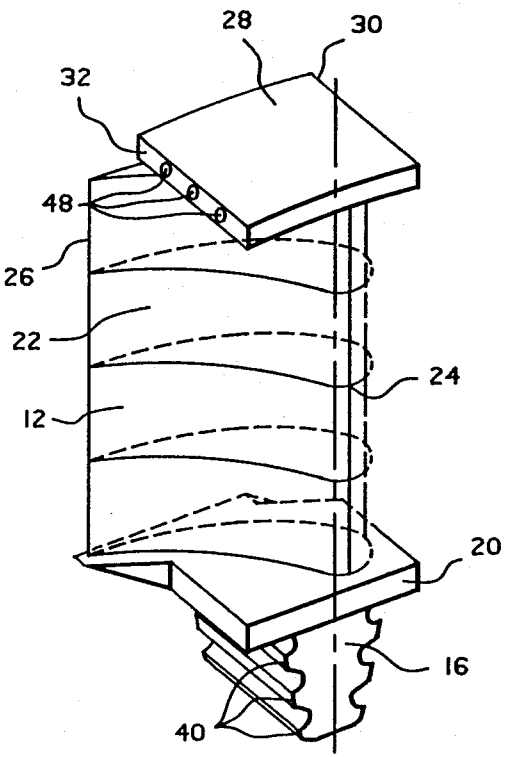
FIG. 6 is a three dimensional sectional view of an integrally shrouded blade incorporating the device of the present invention.

FIGS. 7 and 8 illustrate in three dimensions a device of the present invention as it is incorporated into integrally shrouded blades. FIG. 6 illustrates a single integrally shrouded blade having a root portion 16 with lug portions 40, a blade platform 20, an air foil-shaped blade portion 22 having a leading edge 24 and a trailing edge 26, and a shroud portion 28 having a leading planar surface 30 and a trailing planar surface 32. While turbine rotors and turbine blades can be made of any of a wide variety of materials well known to those of ordinary skill in the art, typically the coefficient of thermal expansion of the rotor material is larger than that of the blade (with its integral shroud) material. Thus, at high temperatures, such as those experienced in a high pressure or intermediate pressure steam turbine, the rotor will expand more than the integrally shrouded blade material. This will result in a circumferential gap 44 between adjacent shrouds. Since the shrouds are no longer in direct contact, or even snubbing contact, the blades act as freestanding blades, which allows the blade structures to experience excessive vibration during normal operation, and can lead to a failure that would be catastrophic within a turbine.

To compensate for these problems caused by the formation of gaps 44 between adjacent integral shrouds 28, the device of the present invention consists of a series of one or more pins 46 pressed into both the leading edge 30 and the trailing edge 32, or into a single edge, of the integral shroud portion 28. These pins are designed such that they have a coefficient of the thermal expansion greater than that of the integrally shrouded blade material and, in addition, equal to or greater than that of the rotor material. In one embodiment, the pins are made out of a material such as 15106FD (Refractaloy 26).

The pins 46 are pressed into machined holes 48 with a tight fit. The pins 46 should be properly bottomed within the machined holes 48. Typically the pins are inserted such that they initially extend beyond the surface of the shroud 30 or 32. Then, after they are inserted, the sides of the shroud portion 28 are machined, as if the pins 46 were not present, to make a smooth continuous surface 30 or 32 on each side of the shroud. The integrally shrouded blades can then be assembled by any normal method.

Once the turbine begins operation, and the materials begin to heat up, a small clearance or gap 44 will, as usual, develop between adjacent shroud portions 28. However, given their greater coefficient of thermal expansion, the pins 46 will expand to a greater degree than the shroud portions 28 and will, thus, begin to protrude outwardly from the planar surfaces 30 and 32 of the shroud portion 28. The pins 46, being properly bottomed within the machined holes 48, will, thus, act as shroud extensions.

By choosing a proper depth of the machined holes 48, and thereby the cold length of the pins 46 due to the surface machining, the width of the gap 44 can be controlled or eliminated at operating temperatures. A deeper machined hole 48 allows for the placement of a longer pin 46 and, given the same percentage rate of expansion, a larger protruding section of pin 46 at operating temperatures. An alternate or supplemental means of controlling this gap is achieved by choosing the pin material to have an appropriate coefficient of thermal expansion in relation to the coefficients of the integrally shrouded blades and the rotor.

Further, a wide variety of pin configurations can be employed without straying from the concepts of the present invention. For example, the number of pins per planar surface can be varied, or pins can be utilized on only one planar surface of any mating pair of surfaces. In a preferred configuration as shown in FIG. 8, pins from the leading planar surface 30 of one shroud portion 28 are located such that they abut against pins protruding from the trailing planar surface 32 of an adjacent shroud portion 28. In this configuration, during thermal expansion, facing pins 46 will contact or snub against one another, reducing vibration of the blade structure. In another configuration, shown in FIG. 7, facing pins 46 can be located such that they abut the opposing planar surface 30 or 32 of the adjacent shroud portion 28, rather than abutting against the adjacent protruding pins. In this configuration, facing pins 46 will contact or snub against the opposing planar surface 30 or 32, reducing vibration of the blade structure in a similar manner.

Still further, while ease of machining indicates the use of cylindrical pins 46, it is certainly possible to use pins having a variety of shapes, e.g., oval, square, or rectangular cross sections.

Thus, a shroud gap control for integrally shrouded blades is disclosed that employs high coefficient of thermal expansion pins pressed with a tight fit into machined holes of shroud portions. While embodiments and applications of this invention have been shown and described, it would be apparent to those skilled in the art that many more modifications are possible without departing from the inventive concepts herein. The invention, therefore, is not to be restricted except in the spirit of the appended claims.

What is claimed is:

1. In a steam turbine of the type having a rotor with a plurality of generally axially extending grooves disposed therearound, a plurality of blades, each blade having an integrally formed root portion in registration with one of the grooves, an integrally formed platform above said root portion, and an integrally formed shroud located above the blade having a leading surface and a trailing surface, an apparatus for reducing the relative motion of the blades comprising:

one or more means to abut adjacent shrouds disposed within at least each of one adjacent pair of leading and trailing surfaces of said integral shrouds, each of said means disposed in a hole located on one of said leading or trailing surfaces, said means radially and axially aligned, and each of said means having a greater coefficient of thermal expansion than said integral shrouds, whereby at a normal operating temperature an end of each of said means abuts an opposing end of another means disposed in an adjacent shroud surface.

2. An apparatus according to claim 1 wherein each means is a pin.

3. An apparatus according to claim 1 wherein said holes have bottoms and said means are initially disposed within said holes such that they abut the bottoms of said holes.

4. An apparatus according to claim 1 wherein the coefficient of thermal expansion of said means is additionally at least equal to the coefficient of thermal expansion of said rotor.

5. The apparatus according to claim 1 wherin said holes are generally tangentially oriented.

6. An apparatus according to claim 2 wherin each surface includes at least two of said pins.

7. An apparatus according to claim 2 wherein said pins are cylindrical.

8. A steam turbine comprising a rotor having a plurality of generally axially extending, generally fir-tree shaped grooves disposed therearound;

a plurality of blades disposed around the rotor;

each blade having an integrally formed, generally fir-tree shaped root in registration with one of the grooves, an integrally formed platform located above the root, and an integrally formed shroud located above the blade having a leading surface and a trailing surface;

at least one pin, disposed within a hole, located on at least each of one adjacent pair of said shroud surfaces of each of said blades, said pins radially and axially aligned and having a coefficient of thermal expansion greater than that of said shroud, whereby at a normal operating temperature an end of each of said pins abuts an opposing end of another pin disposed in an adjacent shroud surface.

9. A stream turbine according to claim 8 wherein said holes have bottoms and said pins are initially disposed within said holes such that they abut the bottoms of said holes.

10. A steam turbine according to claim 8 wherein the coefficient of thermal expansion of said pins is additionally at least equal to the coefficient of thermal expansion of said rotor.

11. A stream turbine according to claim 8 wherein said holes are generally tangentially oriented.

12. A steam turbine according to claim 8 wherein each surface includes at least two of said pins.

13. A steam turbine according to claim 8 wherein said pins are cylindrical.

14. In a stream turbine of the type having a rotor with a plurality of generally axially extending, generally fir-tree shaped grooves dispersed therearound, a plurality of blades, each blade having an integrally formed root portion in registration with one of the grooves, an integrally formed platforms above said root portion, and an integrally formed shroud located above the blade having a leading surface and a trailing surface, a method of assembling the turbine to reduce vibration during operation comprising the steps of:

machining at least one generally tangentially oriented hole into at least each of one adjacent pair of said shroud surfaces;

inserting into each of said holes a pin having a length at least equal to the depth of said hole and being made of a material having a coefficient of thermal expansion greater than that of the shroud material and at least equal to that of the rotor material;

machining the surfaces of said pair of shrouds in conjunction with the pin to form a continuous smooth surface; and inserting the roots of said blades into said grooves, whereby said pins inserted into said pair of shroud surfaces are radially and axially aligned and at a normal operating temperature and end of each of said pins abuts an opposing end of another pin disposed in an adjacent shroud.

15. The method of claim 14 wherein the step of machining the hole includes machining it to a predetermined depth such that the inserted and machined pin will have a length appropriate to provide adequate expansion at operating temperatures to remain in contact with an opposing surface or pin of an adjacent shroud.

16. The method of claim 14 wherein each of said pins is inserted such that an end of said pin abuts the bottom of said hole.

17. A method of reducing blade vibration in a steam turbine having integrally shrouded blades comprising the steps of:

inserting a plurality of pins made of a material having a coefficient of thermal expansion greater than that of the integrally shrouded blades into holes in leading and trailing surfaces of shroud portions of said integrally shrouded blades;

machining said surfaces with said inserted pins to form smooth surfaces; and assembling the steam turbine including the integrally shrouded blades at less than operating temperature such that adjacent shroud portions of the integrally shrouded blades about or abut against each other and said pins are radially and axially aligned, whereby at a normal operating temperature an end of each of said pins abuts an opposing end of another pin disposed in an adjacent shroud.

* * * * *